US005171381A

United States Patent [19]

Mirchandani et al.

[11] Patent Number: 5,171,381

[45] Date of Patent: * Dec. 15, 1992

[54] INTERMEDIATE TEMPERATURE ALUMINUM-BASE ALLOY

[75] Inventors: Prakash K. Mirchandani, Troy, Mich.; Arunkumar S. Watwe; Walter E. Mattson, both of Huntington, W. Va.

[73] Assignee: Inco Alloys International, Inc., Huntington, W. Va.

[ * ] Notice: The portion of the term of this patent subsequent to May 19, 2009 has been disclaimed.

[21] Appl. No.: 662,721

[22] Filed: Feb. 28, 1991

[51] Int. Cl.[5] ..... C22C 21/00; B22F 9/00

[52] U.S. Cl. ..... 148/437; 75/249; 148/438; 148/439; 148/440; 420/528; 420/529

[58] Field of Search ..... 75/249; 148/437, 438, 148/439, 440; 420/528, 529

[56] References Cited

U.S. PATENT DOCUMENTS

| | | | |
|---|---|---|---|
| 4,379,719 | 4/1983 | Hildeman et al. | 419/60 |
| 4,557,893 | 12/1985 | Jatkar et al. | 419/12 |
| 4,624,705 | 11/1986 | Jatkar et al. | 75/239 |
| 4,643,780 | 2/1987 | Gilman et al. | 148/12.7 A |
| 4,743,317 | 5/1988 | Skinner et al. | 148/437 |
| 4,758,273 | 7/1988 | Gilman et al. | 75/249 |
| 4,834,810 | 5/1989 | Benn et al. | 148/437 |
| 4,834,942 | 5/1989 | Frazier et al. | 420/552 |

OTHER PUBLICATIONS

D. L. Erich, Technical Report AFML-TR-79-4210, "Development of a Mechanically Alloyed Aluminum Alloy for 450°-650° F. Service", Jan. 1980, pp. 1-81.

Gilman et al., Metal Powder Report, "Rapidly Solidified Aluminum Alloys for High Temperature/High Stiffness Applications", Sep. 1989, pp. 616-620.

Y.-W. Kim, Industrial Heating, "Advanced Aluminum Alloys for High Temperature Structural Applications", May 1988, pp. 31-34.

Rainen et al., Journal of Metals, "Elevated Temperature Al Alloys for Aircraft Structure," May 1988, pp. 16-18.

*Primary Examiner*—W. Dean

*Assistant Examiner*—Robert R. Koehler

*Attorney, Agent, or Firm*—Blake T. Biederman; Edward A. Steen

[57] ABSTRACT

The invention comprises an alloy having improved intermediate temperature properties at temperatures up to about 316° C. The alloy contains (by weight percent) about 1-6% X contained as an intermetallic phase in the form of $Al_3X$. X is at least one selected from the group consisting of Nb, Ti and Zr. The alloy also contains 0.1-4% strengthener selected from the group consisting of Si and Mg. In addition, the alloy contains about 1-4% C and 0.1-2% O present as aluminum carbides and oxides for grain stabilization.

12 Claims, 3 Drawing Sheets

INTERMEDIATE TEMPERATURE ALUMINUM-BASE ALLOY

FIELD OF INVENTION

This invention relates to mechanical alloyed (MA) aluminum-base alloys. In particular, this invention relates to MA aluminum-base alloys strengthened with an $Al_3X$ type phase dispersoid for applications requiring engineering properties at temperatures up to about 316° C.

BACKGROUND OF THE INVENTION

Aluminum-base alloys have been designed to achieve improved intermediate temperature (ambient to about 600° F. or 316° C.) and high temperature (above about 316° C.) for specialty applications such as aircraft components. Properties critical to improved alloy performance include density, modulus, tensile strength, ductility, creep resistance and corrosion resistance. To achieve improved properties at intermediate and high temperatures, aluminum-base alloys, have been created by rapid solidification, strengthened by composite particles or whiskers and formed by mechanical alloying. These methods of forming lightweight elevated temperature alloys have produced products with impressive properties. However, manufacturers, especially manufacturers of aerospace components, are constantly demanding increased physical properties with decreased density at increased temperatures.

An example of aluminum-base rapid solidification alloys is disclosed in U.S. Pat. Nos. 4,743,317 ('317) and 4,379,719 ('719). Generally, the problems with rapid solidification alloys include limited liquid solubility, increased density and limited mechanical properties. For example, the rapid solidification Al-Fe-X alloys of the '317 and '719 patents have increased density arising from the iron and other relatively high density elements. Furthermore, Al-Fe-X alloys have less than desired mechanical properties and coarsening problems.

An example of a mechanical alloyed composite stiffened alloy was disclosed by Jatkar et al. in U.S. Pat. No. 4,557,893. The MA aluminum-base structure of Jatkar et al. produced a product with superior properties to the Al-Fe-X rapid solidification alloys. However, an increased level of skill is required to produce such composite materials and a further increase in alloy performance would result in substantial benefit to aerospace structures.

A combination rapid solidification and MA aluminum-titanium alloy, having 4–6% Ti, 1–2% C and 0.1–0.2% O, is disclosed by Frazier et al. in U.S. Pat. No. 4,834,942. For purposes of this specification, all component percentages are expressed in weight percent unless specifically expressed otherwise. The alloy of Frazier et al. has lower than desired physical properties at intermediate temperatures.

It is an object of this invention to provide an aluminum-base alloy that facilitates simplified alloy formation as compared to aluminum-base alloys produced by rapid solidification.

It is a further object of this invention to produce an aluminum-base MA alloy having improved intermediate temperature properties.

SUMMARY OF THE INVENTION

The invention comprises an alloy having improved intermediate temperature properties at temperatures up to about 316° C. The alloy contains a total of about 1–6% X contained as an intermetallic phase in the form of $Al_3X$. X is at least one selected from the group consisting of Nb, Ti and Zr. The alloy also contains a total of 0.1–4% strengthener selected from the group consisting of Si and Mg. In addition, the alloy contains about 1–4% C and about 0.1–2% O.

DESCRIPTION OF PREFERRED EMBODIMENT

Figure 1:
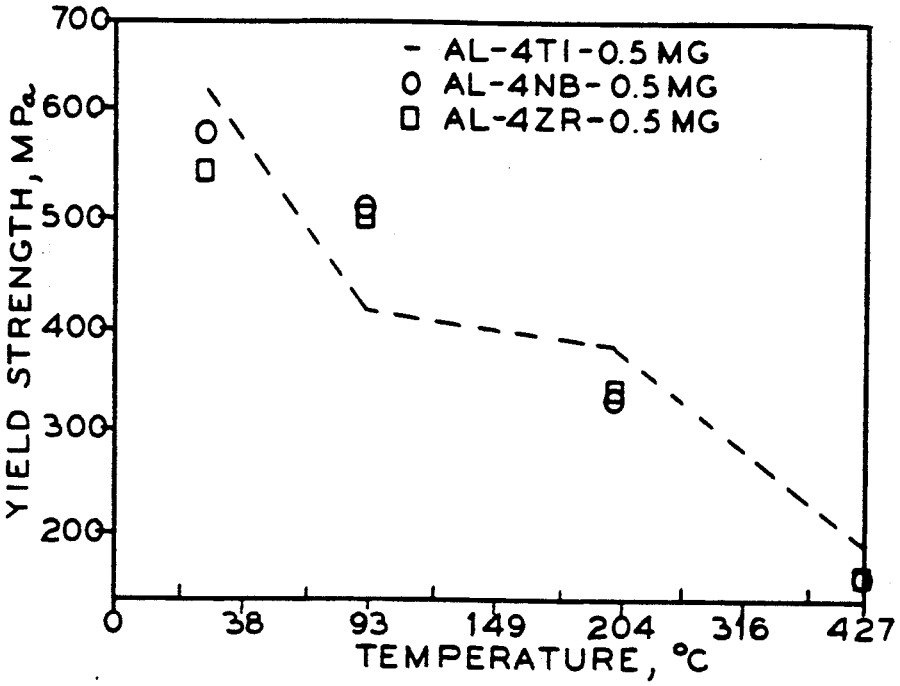
FIG. 1 is a plot of yield strength of MA Al-4(Ti, Nb or Zr)-0.5Mg alloys at temperatures between 24° and 316° C.

The aluminum-base MA alloys of the invention provide excellent engineering properties for applications having operating temperatures up to about 316° C. The aluminum-base alloy is produced by mechanically alloying one or more elements selected from the group of Nb, Ti and Zr. In mechanical alloying, master alloy powders or elemental powders formed by liquid or gas atomization may be used. An $Al_3X$ type phase is formed with Nb, Ti and Zr. These $Al_3X$ type intermetallics provide strength at elevated temperatures because these $Al_3X$ type intermetallics have high stability, a high melting point and a relatively low density. In addition, Nb, Ti and Zr have low diffusivity at elevated temperatures. The MA aluminum-base alloy is produced by mechanically alloying elemental or intermetallic ingredients as previously described in U.S. Pat. Nos. 3,740,210; 4,600,556; 4,623,388; 4,624,705; 4,643,780; 4,668,470; 4,627,659; 4,668,282; 4,557,893 and 4,834,810. The process control agent is preferably an organic material such as organic acids, alcohols, heptanes, aldehydes and ether. Most preferably, process control aids such as stearic acid, graphite or a mixture of stearic acid and graphite are used to control the morphology of the mechanically alloyed powder. Preferably, stearic acid is used as the process control aid.

Powders may be mechanically alloyed in any high energy milling device with sufficient energy to bond powders together. Specific milling devices include attritors, ball mills and rod mills. Specific milling equipment most suitable for mechanical alloying powders of the invention includes equipment disclosed in U.S. Pat. Nos. 4,603,814, 4,653,335, 4,679,736 and 4,887,773.

The MA aluminum-base alloy is strengthened primarily with $Al_3X$ intermetallics and a dispersion of aluminum oxides and carbides. The $Al_3X$ intermetallics may be in the form of particles having a grain size about equal to the size of an aluminum grain or be distributed throughout the grain as a dispersoid. The aluminum oxide ($Al_2O_3$) and aluminum carbide ($Al_4C_3$) form dispersions which stabilize the grain structure. The MA aluminum-base alloy may contain a total of about 1–6% X, wherein X is selected from Nb, Ti and Zr and any combination thereof. In addition, the alloy contains about 1–4% C and about 0.1–2% O and most preferably contains about 0.7–1% O and about 1.2–2.3% C for grain stabilization. Furthermore, for increased matrix stiffness, the MA aluminum-base alloy preferably contains a total of about 2–6% X.

It has also been discovered that a "ternary" addition of Si or Mg may be used to increase tensile properties from ambient to intermediate temperatures. It is recognized that the ternary alloy contains carbon and oxygen in addition to aluminum, (titanium, niobium or zirconium) and (magnesium or silicon). Preferably, about 0.1–4% Si, Mg or a combination thereof is added to improve properties up to about 316° C. Most preferably, the strengthener is either 0.15–1% Mg or 0.5–2% Si.

EXAMPLE 1

A series of alloys were prepared to compare the effects of Nb, Ti and Zr. Elemental powders were used in making Al-4Ti/Nb/Zr-0.5Mg. The powders were charged with 2.5% stearic acid in an attritor. The charge was then milled for 12 hours in argon. The milled powders were then canned and degassed at 493° C. under a vacuum of 50 microns of mercury. The canned and degassed powder was then consolidated to 9.2 cm diameter billets by upset compacting against a blank die in a 680 tonne extrusion press. The canning material was completely removed and the billets were then extruded at 371° C. to 1.3 cm×5.1 cm bars. The extruded bars were then tested for tensile properties. All samples were tested in accordance with ASTM E8 and E21. The tensile properties for the Al-Ti/Nb/Zr-0.5Mg series is given below in Table 1.

TABLE 1

| Temperature (°C.) | Y.S. (MPa) | U.T.S. (MPa) | Elong. (%) | R.A. (%) |
|---|---|---|---|---|
| | | MA Al—4Ti—0.5Mg | | |
| 24 | 627 | 690 | 2.0 | 9.3 |
| 93 | 414 | 448 | 2.0 | 12.3 |
| 204 | 376 | 394 | 6.0 | 20.3 |
| 316 | 186 | 200 | 10.0 | NA |
| | | MA Al—4Nb—0.5Mg | | |
| 24 | 583 | 646 | 8.0 | 21.3 |
| 93 | 513 | 522 | 13.5 | 28.0 |
| 204 | 325 | 348 | 9.5 | 29.3 |
| 316 | 156 | 167 | 5.0 | 43.0 |
| | | MA Al—4Zr—0.5Mg | | |
| 24 | 545 | 599 | 4.0 | 10.1 |
| 93 | 507 | 514 | 11.5 | 13.0 |
| 204 | 335 | 378 | 8.5 | 16.0 |
| 316 | 158 | 163 | 3.5 | 16.0 |

Figure 2:
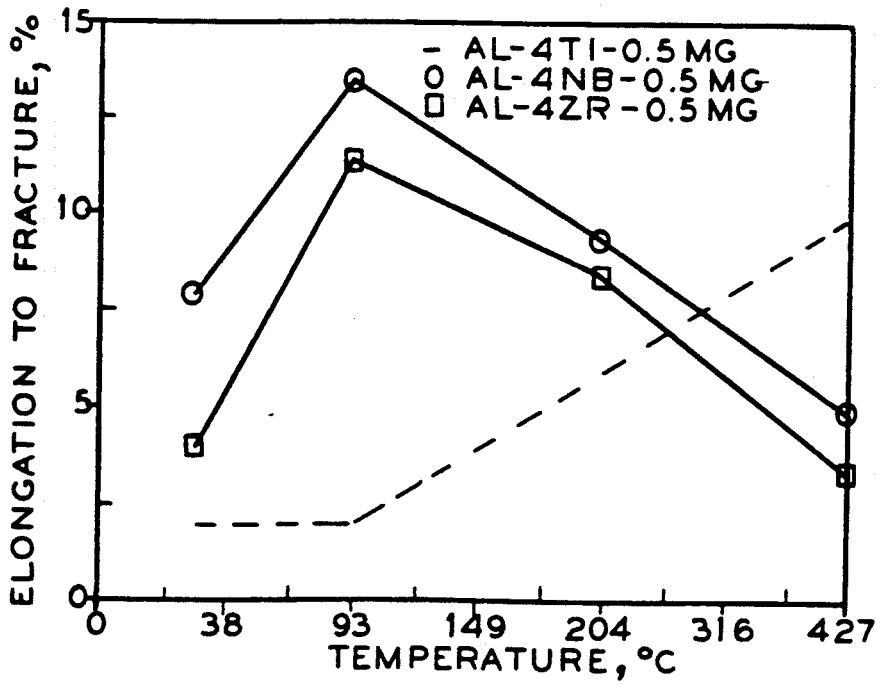
FIG. 2 is a plot of tensile elongation of MA Al-4(Ti, Nb or Zr)-0.5Mg alloys at temperatures between 24° and 316° C.

A plot of the Ti/Nb/Zr series yield strength is given in FIG. 1 and tensile elongation is given in FIG. 2. Table 1 and FIGS. 1 and 2 show that an equal weight percent of Nb or Zr provide lower strength at ambient and elevated temperatures. Tensile elongation levels of (4Nb or 4Zr)-0.5Mg have a maximum at about 93° C. and tensile elongation levels of Al-4Ti-0.5Mg generally increase with temperature.

The solid solubilities of titanium, niobium and zirconium in aluminum, the density of $Al_3Ti$, $Al_3Nb$ and $Al_3Zr$ intermetallics and the calculated volume fractions of intermetallic $Al_3Ti$, $Al_3Nb$ and $Al_3Zr$ formed with 4 wt. % Ti, Nb and Zr respectively, are given below in Table 2.

TABLE 2

| Transition Metal | Solubility in Al, wt. % | Density of Intermetallic g/cm$^3$ | Volume of Intermetallics, % |
|---|---|---|---|
| Titanium | 0.1 | 3.4 | 8.8 |
| Niobium | 0.1 | 4.54 | 4.6 |
| Zirconium | 0.1 | 4.1 | 5.1 |

Although Al-(4Nb or 4Zr)-0.5Mg alloys contain only about half the amount of intermetallics by volume of Al-4Ti-0.5Mg alloy, the Al-(4Nb or 4Zr)-0.5Mg alloys have only marginally lower strength levels at ambient temperatures. Furthermore, the tensile elongation or ductility of Al-4Ti-0.5Mg increases with temperature, whereas that of Al-(4Nb or 4Zr)-0.5Mg exhibits a maximum at about 73° C. These significant differences in mechanical behavior of these alloys most likely arise from differences in morphology and deformation characteristics of the intermetallics. Mechanical alloying of Nb and Zr with aluminum produces $Al_3Nb$ and $Al_3Zr$ intermetallics randomly distributed throughout an aluminum matrix. The average size of the $Al_3Nb$ and $Al_3Zr$ particles is about 25 nm. It is believed that $Al_3Zr$ and $Al_3Nb$ particles provide Orowan strengthening that is not effective at elevated temperatures. However, $Al_3Ti$ particles have an average size of about 250 nm, roughly the same size as the MA aluminum grains. The larger grained $Al_3Ti$ particles are believed to strengthen the MA aluminum by a different mechanism than $Al_3Nb$ and $Al_3Zr$ particles. These $Al_3Ti$ particles do not strengthen primarily with Orowan strengthening and are believed to increase diffused slip at all temperatures, whereas an absence of diffused slip in alloys containing $Al_3Nb$ or $Al_3Zr$ leads to low ductility at elevated temperatures. A slight difference between the $Al_3Nb$ and $Al_3Zr$ may be attributed to slightly different lattice structures. $Al_3Nb$ and $Al_3Ti$ have a $DO_{22}$ lattice structure and $Al_3Zr$ has a $DO_{23}$ lattice structure. However, the differences in morphology appear to have the greatest effect on tensile properties.

Titanium is the preferred element to use to form an $Al_3X$ type intermetallic. Titanium provides the best combination of ambient temperature and elevated temperature properties. Most preferably, about 1.5–4.5% Ti is used. In addition, a combination of Ti and Zr or Nb ay be used to optimize the strengthening mechanisms of $Al_3Ti$ and the Orowan mechanism of $Al_3Zr$ and $Al_3Nb$.

EXAMPLE 2

A series of Al-Ti-Si alloys were tested to determine the effect of Si on Al-Ti alloys stabilized with $Al_2O_3$ and $Al_4C_3$ dispersoids. The procedure of Example 1 was used except an Al-12Si master alloy was employed to mechanically alloy Al-4Ti-Si alloys for evaluation. Alternatively, elemental ingredients may be used. Table 3 below illustrates the improved tensile properties achieved when adding a Si strengthener.

TABLE 3

| Temperature (°C.) | Y.S. (MPa) | U.T.S. (MPa) | Elong. (%) | R.A. (%) |
|---|---|---|---|---|
| | | Al-4Ti | | |
| 24 | 398 | 426 | 14.0 | 37.3 |
| 93 | 348 | 366 | 10.0 | 38.3 |
| 204 | 287 | 302 | 7.0 | 24.7 |
| 316 | 202 | 205 | 7.0 | 28.1 |
| | | Al—4Ti—0.5Si | | |
| 24 | 497 | 558 | 10.5 | 33.4 |

TABLE 3-continued

| Temperature (°C.) | Y.S. (MPa) | U.T.S. (MPa) | Elong. (%) | R.A. (%) |
|---|---|---|---|---|
| 93 | 472 | 476 | 7.5 | 23.0 |
| 204 | 343 | 376 | 8.5 | 19.7 |
| 316 | 196 | 205 | 6.0 | 33.0 |
| | | Al—4Ti—1Si | | |
| 24 | 513 | 595 | 6.0 | 19.3 |
| 93 | 412 | 461 | 12.0 | 27.1 |
| 204 | 316 | 348 | 7.0 | 12.3 |
| 316 | 255 | 264 | 11.0 | 28.9 |
| | | Al—4Ti—2Si | | |
| 24 | 538 | 604 | 6.5 | 17.1 |
| 93 | 471 | 476 | 8.5 | 18.5 |
| 204 | 339 | 355 | 9.0 | 16.0 |
| 316 | 162 | 170 | 5.0 | 31.0 |

Figure 3:
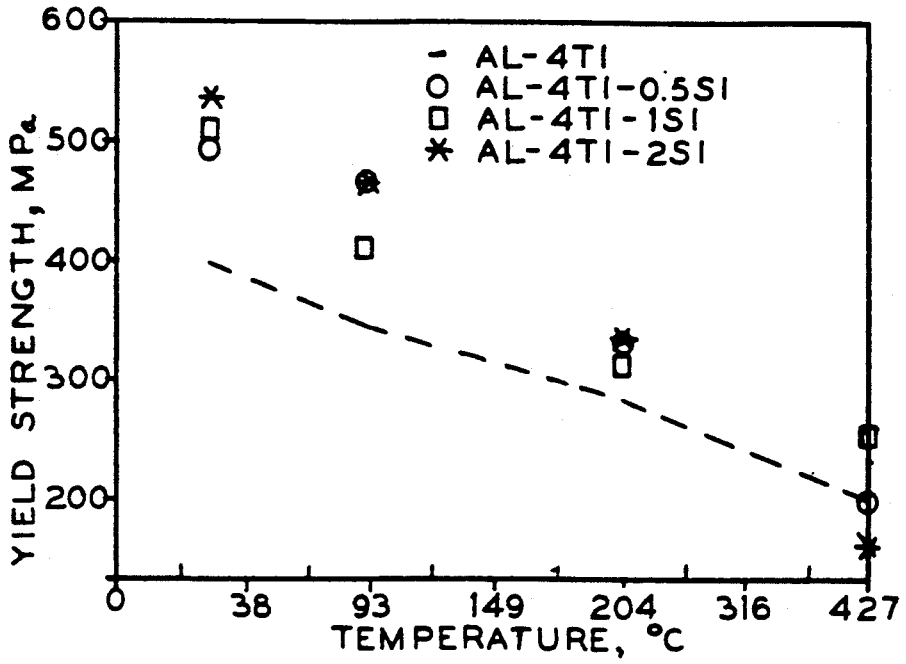
FIG. 3 is a plot of yield strength of MA Al-4Ti-Si alloys at temperatures between 24° and 316° C.
Figure 4:
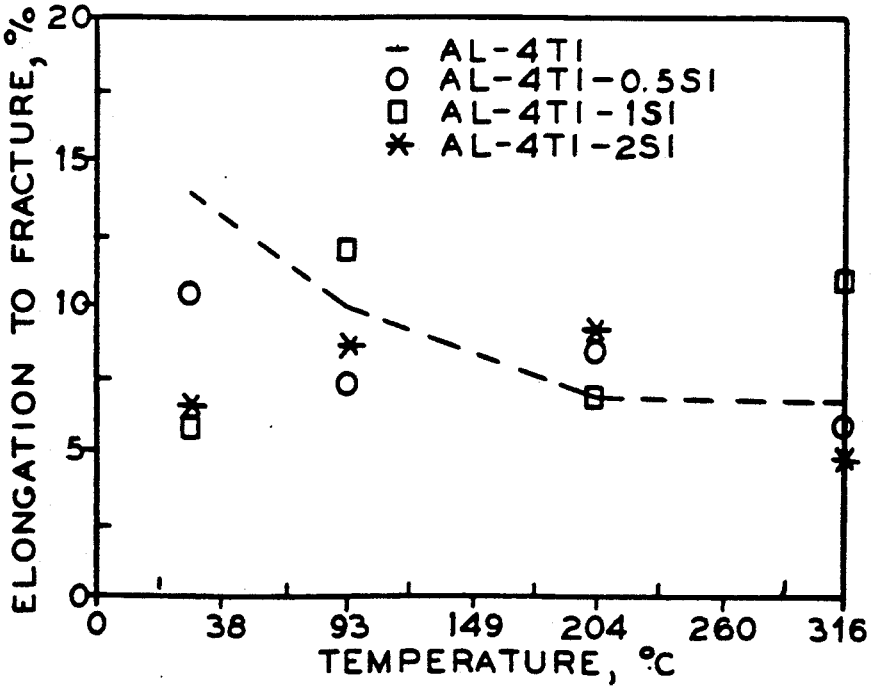
FIG. 4 is a plot of tensile elongation of MA Al-4Ti-Si alloys at temperatures between 24° and 316° C.

FIG. 3 illustrates the improved yield strength obtained when adding Si; and FIG. 4 illustrates the effect of Si on tensile elongation. Appreciable strengthening is achieved with Si at ambient temperatures. However, the strengthening effect of Si decreases with increasing temperatures. Tensile elongation levels of the silicon-containing alloys at all temperatures tested were only moderately affected by the addition of Si. Preferably, for Al-X-Si ternary, 0.5–2.0 Si is used to strengthen the alloy; and most preferably about 0.75–1.25% Si is used to strengthen the alloy.

EXAMPLE 3

Elemental powders were mechanically alloyed with the process of Example 1 to produce MA Al-Ti-Mg alloys. Table 4 below lists properties achieved with the MA Al-Ti-Mg series of alloys.

TABLE 4

| Temperature (°C.) | Y.S. (MPa) | U.T.S. (MPa) | Elong. (%) | R.A. (%) |
|---|---|---|---|---|
| | | Al—2Ti | | |
| 24 | 443 | 501 | 11.6 | 40.8 |
| 93 | 431 | 438 | 7.0 | 27.5 |
| 204 | 321 | 343 | 8.5 | 14.0 |
| 316 | 209 | 210 | 14.0 | 17.5 |
| 427 | 136 | 136 | 21.0 | 2.5 |
| 538 | 66 | 66 | 4.0 | 7.0 |
| | | Al—2Ti—0.25Mg | | |
| 24 | 497 | 549 | 10.0 | 32.0 |
| 93 | 439 | 474 | 9.0 | 28.0 |
| 204 | 368 | 381 | 9.0 | 25.2 |
| 316 | 211 | 216 | 16.0 | 32.2 |
| 427 | 128 | 128 | 10.0 | 49.7 |
| 538 | 18 | 21 | 3.0 | 4.0 |
| | | Al—2Ti—0.5Mg | | |
| 24 | 583 | 654 | 7.0 | 24.6 |
| 93 | 515 | 573 | 10.0 | 24.6 |
| 204 | 370 | 402 | 15.0 | 25.9 |
| 316 | 176 | 203 | 18.0 | 35.0 |
| 427 | 110 | 116 | 11.0 | 55.9 |
| 538 | 22 | 25 | 21.0 | 73.8 |
| | | Al—4Ti | | |
| 24 | 398 | 426 | 14.0 | 37.3 |
| 93 | 344 | 366 | 10.0 | 38.3 |
| 204 | 287 | 302 | 7.0 | 24.7 |
| 316 | 202 | 205 | 7.0 | 28.1 |
| 427 | 128 | 129 | 21.0 | 36.0 |
| 538 | 56 | 57 | 32.0 | 37.0 |
| | | Al—4Ti—0.25Mg | | |
| 24 | 527 | 559 | 10.0 | 28.9 |
| 93 | 427 | 486 | 7.0 | 23.3 |
| 204 | 354 | 378 | 8.0 | 18.2 |
| 316 | 235 | 245 | 9.0 | 11.6 |
| 427 | 136 | 136 | 9.0 | 51.6 |
| 538 | 63 | 65 | 14.0 | 51.9 |
| | | Al—4Ti—0.5Mg | | |
| 24 | 627 | 690 | 2.0 | 9.3 |

TABLE 4-continued

| Temperature (°C.) | Y.S. (MPa) | U.T.S. (MPa) | Elong. (%) | R.A. (%) |
|---|---|---|---|---|
| 93 | 414 | 448 | 2.0 | 12.0 |
| 204 | 376 | 394 | 6.0 | 20.3 |
| 316 | 186 | 200 | 10.0 | NA |
| 427 | 128 | 130 | 13.0 | 57.6 |
| 538 | 52 | 54 | 42.0 | 65.1 |
| | | Al-4Ti—1Mg | | |
| 24 | 697 | 772 | 3.0 | NA |
| 93 | 536 | 596 | 7.0 | NA |
| 204 | 324 | 376 | 12.0 | NA |
| 316 | 181 | 185 | 8.0 | NA |
| 427 | 110 | 114 | 10.0 | NA |
| 538 | 48 | 51 | 21.0 | 63.8 |
| | | Al—4Ti—2Mg | | |
| 24 | 690 | 745 | 2.0 | NA |
| 93 | 505 | 638 | 2.0 | 4.7 |
| 204 | 358 | 358 | 11.0 | 26.5 |
| 316 | 170 | 174 | 11.0 | 45.7 |
| 427 | 124 | 127 | 17.0 | 58.3 |
| 538 | 56 | 57 | 30.0 | 70.0 |
| | | Al—6Ti | | |
| 24 | 450 | 523 | 13.0 | 28.0 |
| 93 | 410 | 431 | 5.0 | 13.1 |
| 204 | 305 | 324 | 8.0 | 11.0 |
| 316 | 198 | 205 | 7.0 | 22.3 |
| 427 | 125 | 132 | 8.0 | 25.3 |
| 538 | 64 | 66 | 10.0 | 18.0 |
| | | Al—6Ti—0.5Mg | | |
| 24 | 605 | 713 | 2.9 | 10.0 |
| 93 | 536 | 586 | 4.7 | 14.0 |
| 204 | 326 | 366 | 5.6 | 6.8 |
| 316 | 186 | 194 | 10.4 | 21.0 |
| 427 | 101 | 104 | 12.8 | 48.8 |
| 538 | 39 | 39 | 15.6 | 52.6 |

Referring to Table 4, Mg increased room and intermediate temperature strength properties at 2, 4 and 6% Ti. At temperatures above about 427° C., Mg no longer strengthens the alloy. However, Mg is a particularly effective strengthener at temperatures up to about 316° C. Furthermore, at about 4% Ti or between about 3 and 5% Ti, Mg increases ambient temperature strength and elevated temperature ductility.

Figure 5:
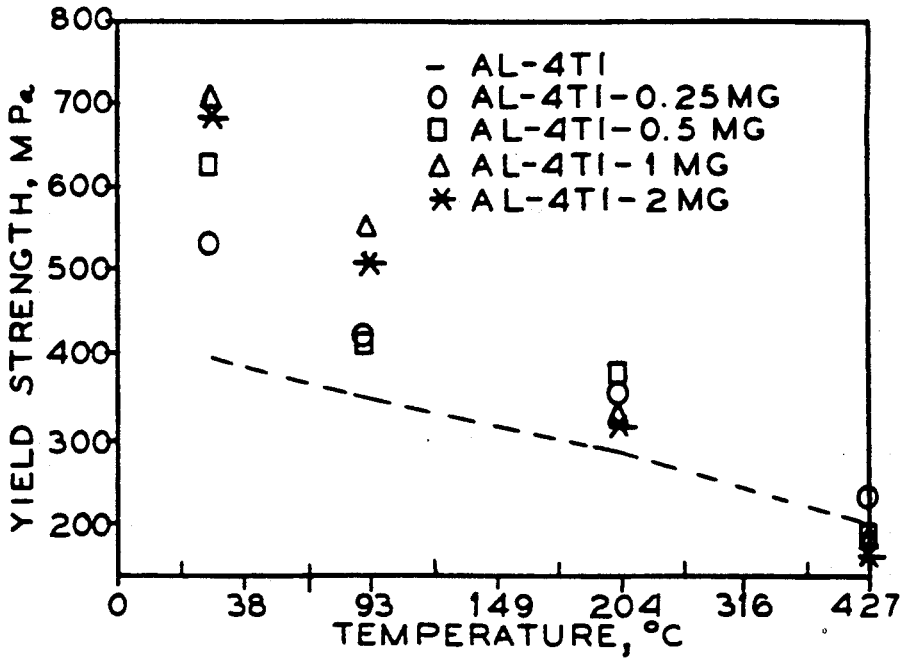
FIG. 5 is a plot of yield strength of MA Al-4Ti-Mg alloys at temperatures between 24° and 316° C.
Figure 6:
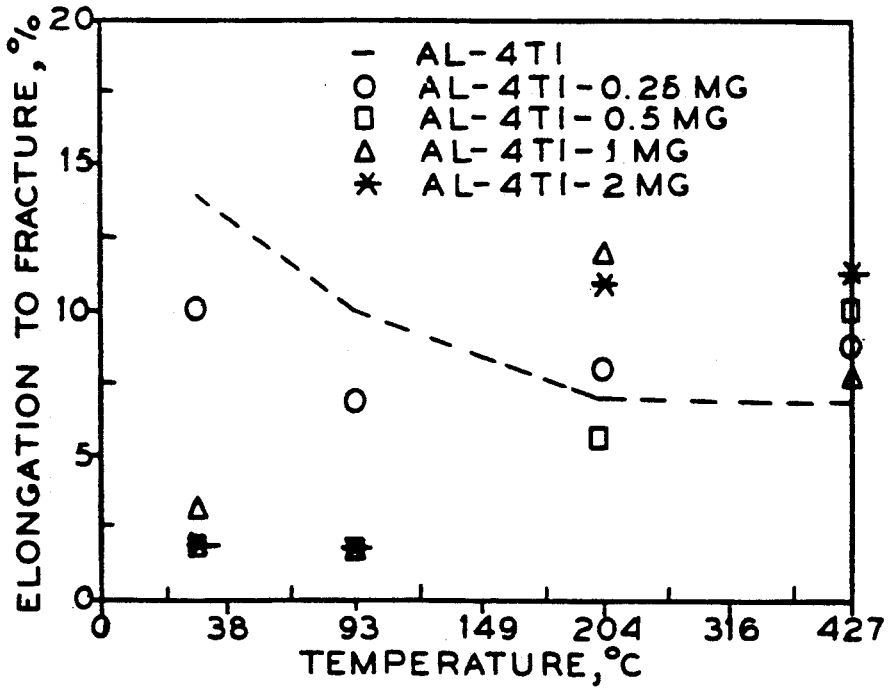
FIG. 6 is a plot of tensile elongation of MA Al-4Ti-Mg alloys at temperatures between 24° and 316° C.

Referring to FIG. 5, which compares yield strength of Al-4Ti-Mg alloys at ambient temperatures to 316° C., the plot illustrates that Mg significantly increases yield strength. The strengthening effect of Mg decreases with increasing temperature. This effect of temperature is not as strong for Si as it is for Mg. Referring to FIG. 6, which compares tensile elongation or ductility of Al-4Ti-Mg alloys at ambient temperatures to 316° C. FIG. 6 illustrates that although Mg decreases ambient temperature ductility, Mg increases intermediate temperature ductility. Preferably, for Al-X-Mg ternary, about 0.15–1.0% Mg is used to strengthen the alloy.

It is believed that Mg strengthens by solid solution hardening and that Si strengthens by diffusing into $Al_3Ti$ and also by forming a ternary silicide having the composition $Ti_7Al_5Si_{12}$. It is recognized that a combination of Mg and Si may be used. However, it has been found that a combination of Mg and Si strengtheners is not preferred. The combination of Mg and Si strengtheners has been found to have a negative effect upon physical properties in comparison to Mg without Si or Si without Mg. For this reason it is preferred that either Si or Mg be used as the ternary strengthener not a combination of Si and Mg.

Table 5 below compares MA Al-4Ti-0.25 Mg and MA Al-4Ti-1Si to state of the art high temperature alloys produced by rapid solidification.

TABLE 5

| Alloy | Ambient Temperature Yield Strength (MPa) | 316° C. Yield Strength (MPa) | Specific Modulus (cm × $10^6$) |
|---|---|---|---|
| Al—4Ti—0.25Mg | 527 | 235 | 310 |
| Al—4Ti—1Si | 513 | 255 | 310 |
| FVS0812* | 390 | 244 | 308 |
| AL—7Fe—6Ce** | 379 | 207 | 269 |

*"Rapidly Solidified Aluminum Alloys for High Temperature/High Stiffness Applications," P. S. Gilman and S. K. Das, Metal Powder Report, September 1989, pp. 616–620.

**"Elevated Temperature Aluminum Alloys for Aircraft Structures," R. A. Rainen and J. C. Ekvall, Journal of Metals, May 1988, pp. 16–18.

As illustrated in Table 5, the alloy of the invention provides a significant improvement over the prior "state of the art" Al-Fe-X alloys. The major advantages are an increased ambient temperature yield strength with improved yield strength properties up to about 316° C. and an improved specific modulus.

Table 6 below contains specific examples of MA aluminum-base alloys within the scope of the invention (the balance of the composition being Al with incidental impurities). Furthermore, the invention contemplates any range definable by any two values specified in Table 6 or elsewhere in the specification and range definable between any specified values of Table 6 or elsewhere in the specification. For example, the invention contemplates Al-4Zr-2Si and Al-2.9Zr-1.75Si.

TABLE 6

| Ti | Nb | Zr | Mg | Si |
|---|---|---|---|---|
| 2 | 1 | 1 | 1 | |
| 4 | | | 0.2 | |
| 2 | 2 | 2 | | 1.2 |
| | 4 | | 0.5 | |
| | | 4 | | 1.1 |
| 6 | | | 0.25 | |
| 5 | 0.5 | 0.5 | | 1.0 |
| 4 | | | 0.35 | |
| 4 | | | | 0.9 |
| 2 | | | 0.5 | |

The nominal composition and chemical analysis of alloys tested were within a relatively close tolerance. Table 7 below contains the nominal composition and chemical analysis of alloys tested.

TABLE 7

| Nominal Composition | Ti | Nb | Zr | Mg | Si | C | O |
|---|---|---|---|---|---|---|---|
| Al—4Ti | 4.27 | — | — | — | — | 1.78 | 0.62 |
| Al—4Ti—0.5Mg | 3.79 | — | — | 0.53 | — | 1.88 | 0.67 |
| Al—4Nb—0.5Mg | — | 3.72 | — | 0.53 | 0.07 | 1.88 | 0.71 |
| Al—4Zr—0.5Mg | — | — | 3.78 | 0.55 | 0.06 | 1.88 | 0.69 |
| Al—4Ti—0.5Si | 3.76 | — | — | — | 0.55 | 1.78 | 0.67 |
| Al—4Ti—1Si | 3.86 | — | — | — | 0.98 | 1.81 | 0.85 |
| Al—4Ti—2Si | 3.78 | — | — | — | 1.83 | 1.82 | 0.73 |
| Al—2Ti | 1.95 | — | — | — | — | 1.97 | 0.60 |
| Al—2Ti—0.25Mg | 1.86 | — | — | 0.16 | 0.07 | 1.95 | 0.66 |
| Al—2Ti—0.5Mg | 1.82 | — | — | 0.5 | 0.05 | 1.96 | 0.68 |
| Al—4Ti—0.25Mg | 3.65 | — | — | 0.25 | 0.04 | 1.86 | 0.64 |
| Al—4Ti—0.5Mg | 3.8 | — | — | 0.5 | — | 1.91 | 0.58 |
| Al—4Ti—1Mg | 3.64 | — | — | 0.98 | 0.08 | 1.97 | 0.77 |
| Al—6Ti | 5.79 | — | — | — | — | 1.75 | 0.71 |
| Al—6Ti—0.5Mg | 5.74 | — | — | 0.45 | — | 1.88 | 0.66 |

In conclusion, alloys strengthened by $Al_3X$ type phase are significantly improved by small amounts of Mg or Si. The addition of Si or Mg greatly increases tensile and yield strength with a minimal loss of ductility. In fact, Mg actually increases ductility at elevated temperatures. The alloys of the invention are formed simply by mechanically alloying with no rapid solidification or addition of composite whiskers or particles. In addition, the tensile properties and intermediate temperature properties of the ternary stiffened MA aluminum-base titanium alloy are significantly improved over the similar prior art alloys produced by rapid solidification, composite strengthening or mechanical alloying.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A MA aluminum-base alloy having improved intermediate temperature properties at temperatures up to about 316° consisting essentially of by weight percent a total of about 1–6% X, wherein X is contained in an intermetallic phase in the form of $Al_3X$ and X is at least one selected from the group consisting of Nb, Ti and Zr, about 0.1–4% of a strengthener, the strengthener being selected from the group selected of Si and Mg.

2. The alloy of claim 1 wherein X is Ti.

3. The alloy of claim 1 wherein said intermetallic phase contains about 1.5–4.5% of Ti.

4. The alloy of claim 1 wherein said strengthener contains magnesium.

5. The alloy of claim 4 wherein said strengthener is about 0.15–1% of the MA aluminum-base alloy.

6. The alloy of claim 1 wherein said strengthener contains silicon.

7. The alloy of claim 6 wherein said strengthener is about 0.5–2% of the MA aluminum-base alloy.

8. The alloy of claim 1 including about 1–4% C and about 0.1–2% O.

9. A MA aluminum-base alloy having improved intermediate temperature properties at temperatures up to about 316° consisting essentially of by weight percent about 1.5–4.5% Ti, said Ti being contained in intermetallic $Al_3Ti$ phase, a strengthener for low temperature strength and intermediate temperature ductility, the strengthener being selected from the group consisting of about 0.15–1% Mg and about 0.5–2% Si wherein either said Mg or Si is selected independently, about 1–4% C and about 0.1–2% O, said C and O being contained in the form of aluminum compound dispersoids for stabilizing grains of the MA aluminum-base alloy.

10. The alloy of claim 9 wherein said aluminum-base alloy contains about 0.7–1% O and about 1.2–2.3% C.

11. The alloy of claim 9 wherein said aluminum-base alloy contains 0.15–1% Mg.

12. The alloy of claim 9 wherein said aluminum-base alloy contains 0.5–2% Si.

* * * * *

UNITED STATES PATENT AND TRADEMARK OFFICE

CERTIFICATE OF CORRECTION

PATENT NO. : 5,171,381

DATED : DEC. 15, 1992

INVENTOR(S) : PRAKASH K. MIRCHANDANI, ARUNKUMAR S. WATWE, WALTER E. MATTSON, RAYMOND C. BENN

It is certified that error appears in the above-identified patent and that said Letters Patent is hereby corrected as shown below:

On the title page, item: "[75] Inventors" should include

--Raymond C. Benn, Madison, Conn.--

Signed and Sealed this

Ninth Day of November, 1993

Bruce Lehman

*Attest:*

BRUCE LEHMAN

*Attesting Officer*

*Commissioner of Patents and Trademarks*